United States Patent [19]

Hakansson

[11] 4,172,416

[45] Oct. 30, 1979

[54] APPARATUS FOR DEWATERING A SUSPENSION

[75] Inventor: Sven A. S. Håkansson, Nynäshamn, Sweden

[73] Assignee: Rederiaktiebolaget Nordstjernen, Stockholm, Sweden

[21] Appl. No.: 906,236

[22] Filed: May 15, 1978

Related U.S. Application Data

[63] Continuation of Ser. No. 665,279, Mar. 9, 1978, abandoned.

[51] Int. Cl.[2] ..... B30B 9/24

[52] U.S. Cl. ..... 100/118; 210/384; 210/401

[58] Field of Search ..... 100/118–121, 100/151–154; 210/384, 386, 400, 401; 162/360, 358

[56] References Cited

U.S. PATENT DOCUMENTS

| | | | |
|---|---|---|---|
| 816,414 | 3/1906 | Witmer | 100/118 X |
| 1,369,335 | 2/1921 | Goodfellow | 100/121 |
| 2,987,988 | 6/1961 | Robledano | 100/118 |
| 3,459,123 | 8/1969 | Begiebing | 100/118 |
| 3,799,052 | 3/1974 | Kusters et al. | 100/154 |
| 3,896,030 | 7/1975 | Bahr | 100/118 |
| 4,019,431 | 4/1977 | Bastgen | 210/384 |

FOREIGN PATENT DOCUMENTS

| | | | |
|---|---|---|---|
| 2645 | of 1877 | United Kingdom | 100/118 |

*Primary Examiner*—Peter Feldman

*Attorney, Agent, or Firm*—Brumbaugh, Graves, Donohue & Raymond

[57] ABSTRACT

An apparatus for dewatering aqueous materials such as a suspension, e.g. a slurry, by continuous pressing of the materials under high pressure. The dewatering is carried out in transport of the suspension between two driven webs which exert a pressure against the suspension, the latter by enclosing the webs at least partly about at least one press roll being subjected to an increased pressure by the enclosure to increase the dewatering effect, and at least the outer web relative to the press roll being pervious to the pressed out water content.

9 Claims, 5 Drawing Figures

APPARATUS FOR DEWATERING A SUSPENSION

This is a continuation, of application Ser. No. 665,279, filed Mar. 9, 1978, now abandoned.

This invention relates to an apparatus for dewatering aqueous materials such as suspensions, predewatered suspensions, preferably slurry, by continuously pressing said materials under high pressure, thereby obtaining a comparatively high dry contact.

It is commonly known to press slurry between a wire cloth web and a roll, about which the wire cloth web runs under a certain enclosing angle. It is also known to introduce the slurry between two wire cloth webs, of which at least one web is pervious to the liquid phase, and these webs enclose one or several rolls for obtaining dewatering.

The squeezing pressure subjected to the slurry when using the above mentioned known dewatering process is partly a function of the stretch to which the wire cloth webs may be exerted. A wire cloth web, however, has a troublesome limited strength and particularly difficulties exist in joining the ends of the web so that the joint in a strength point of view does not form a substantially weakened part of the web.

The squeezing pressure subjected to the slurry is also a function of the diameter of the roll, which the web encloses, in such a way that a smaller diameter causes a higher squeezing pressure on the slurry. Slighter rolls, however, involve a shorter squeezing pressure length and thereby shorter length of time, during which the slurry is subjected to increased pressure, and the time factor also has a certain significance for the dewatering result, which will be described more in detail below.

It is also known to exert increased pressure upon the slurry by arrangement of pressure rollers or other mechanical devices, which at some locations, where the webs enclose a dewatering roll, from the outside relative said roll press against the outer web and thus against the slurry. Such an arrangement is for instance disclosed in Swedish Patent specification No. 109 941 and U.S. Pat. No. 2,711,130. The pressure thus caused, however, is extremely momentary and only a small part of the water will be pressed out of the slurry before the pressure again is released.

As mentioned above the time factor has certain significance upon the dewatering result. It has been proved that the time factor—the time during which the slurry is subjected to a certain pressure—has in the begining a great significance to the dewatering but the more the time is extended the less this means in dewatering point of view. This fact is illustrated in FIG. 1 of the accompanying drawings, in which Figure diagrams showing obtained dry content as a function of time are shown. Curve A shows a representative dewatering course when slurry is subjected to a certain constant pressure. If the pressure is doubled another course, curve B is obtained. Both these curves show a dewatering more and more decreasing with time and they approach asymptotically a maximum value for the dry content at each pressure. If the pressure is further increased discontinuities arise, for instance as shown with curve C which shows that the slurry particles at a certain pressure obviously close the passage for the water to drain. It is instead possible to dewater at the beginning along for instance curve B, release the pressure and thereafter increase the pressure further, whereby a course illustrated by curve D can be obtained.

The object of the present invention is to eliminate the above mentioned difficulties and drawbacks when using apparatus according to prior art and to obtain an essential higher dewatering effect compared with the dewatering effect possible to obtain when using previously known technique.

The method according to the invention is herewith a development of previous known method for dewatering a suspension, particularly slurry, during transport of the suspension between two driven webs, which excert a pressure against the intermediate suspension, the suspension by enclosing the webs at least partly about at least one press roll being subjected to an increased pressure caused by said enclosure and thereby caused increased dewatering, at least the outer web relative to the press roll being pervious to the water.

To obtain said object and in order to increase said dewatering caused only by said enclosure outwardly through said pervious web the method according to the invention is characterized in that the suspension between the webs is pressed further in addition to the pressure caused by said enclosing by applying a pressure to the outer water-pervious web along pressure pathes running spaced apart continuously in the enclosing direction at least over a substantial part of said enclosure and having an extension in transverse direction relative to the enclosing direction, said increased dewatering outwardly through the outer water-pervious web taking place mainly through the spaces between the pressure pathes during the time period that passes while the suspension is transported along said pressure pathes and is subjected to said applied further pressure.

Compared with prior art it has by the method according to the invention proved to be possible to reach substantially higher dry contents. For many kinds of slurries from wastewater treatment work dry contents of substantially above 30% have been obtained. The cause for the high dewatering effect is the inventive combination of said further, high pressure acting along said pathes, the long pressure time made possible by the extension of the pathes and the possibility for the pressed-out water to flow away. Furthermore, the advantage is obtained that in a suspension layer possible uneven distributed between the webs, said pathes bring about, that full pressure nevertheless is exerted over the whole width of the suspension layer in spite of said uneveness. This particular advantage is greater the less aqueous the suspension to be pressed is.

As mentioned above the time factor has an essential significance upon the dewatering effect. It is accordingly appropriate to have the webs enclosing and pressing in the direction towards the press roll about as large part of the press roll as is in fact possible. An enclosing angle of 180° or more is accordingly advantageous and the present invention admits large enclosing angles.

Preferably according to the invention said further pressure is adjustable in order to adapt said pressure to suspensions of different kinds.

Furthermore, the present invention renders it possible to exert higher press power along outer pathes than along intermediate pathes, thereby guaranteeing that also the suspension layer usually thinned out towards the edges of the webs is pressed with sufficient and required pressure and moreover a measure has been taken to hinder the suspension to flow out towards the edges of the webs. By this, an essential problem has been solved, i.e., the problem that the suspension tends to flow out towards the edges during the pressing.

The present invention relates to an apparatus for carrying out the above mentioned method. The apparatus includes two contineously running endless webs, which run under pressure in the direction towards each other along a pressure path, an inlet in front of said pressure path for introducing the suspension to be dewatered between the webs, an outlet after said pressure path for the dewatered suspension and at least one press roll arranged along said pressure path, said press roll being to an essential part of its circumference enclosed by the webs, at least the outer web, relative to the press roll, being pervious to the water. In order to obtain said further pressure of the webs in the direction towards the press roll, the apparatus according to the invention is characterized in spaced apart band-shaped elements extending in the direction of said pressure path along said enclosed part of the press rolls and means for pressing said spaced apart band-shaped elements against said outer web.

Further characteristics and advantages of the present invention will be evident from the following description of embodiments of the invention with reference to the accompanying drawings.

Figure 1:
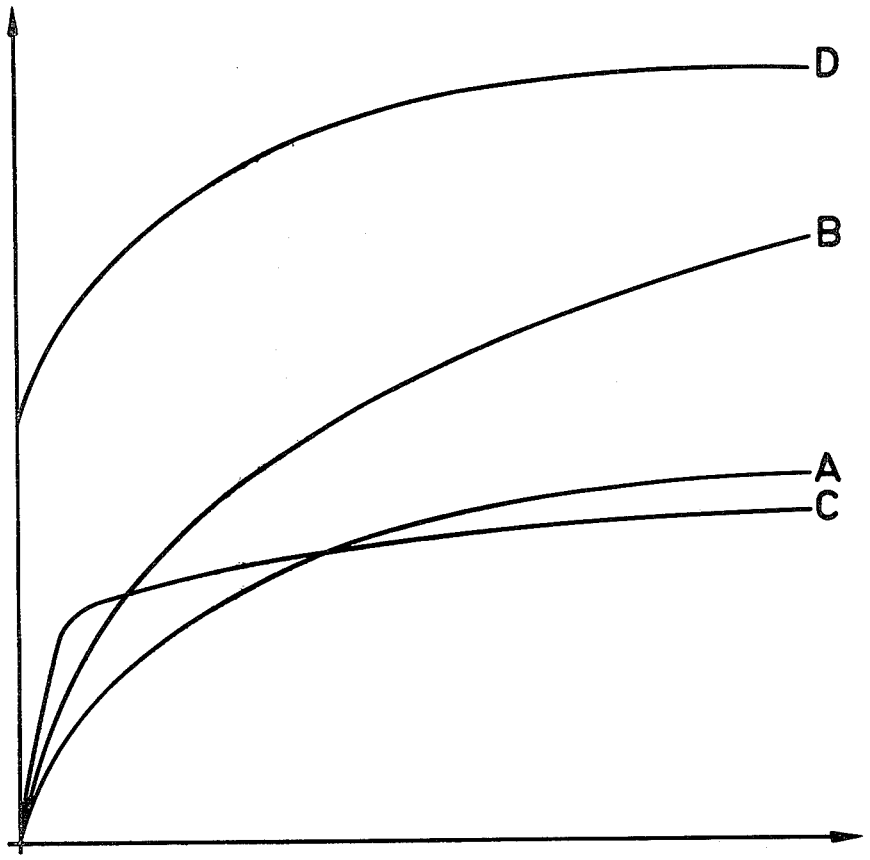
FIG. 1 shows the above described diagram of obtained dry content as a function of time.
Figure 2:
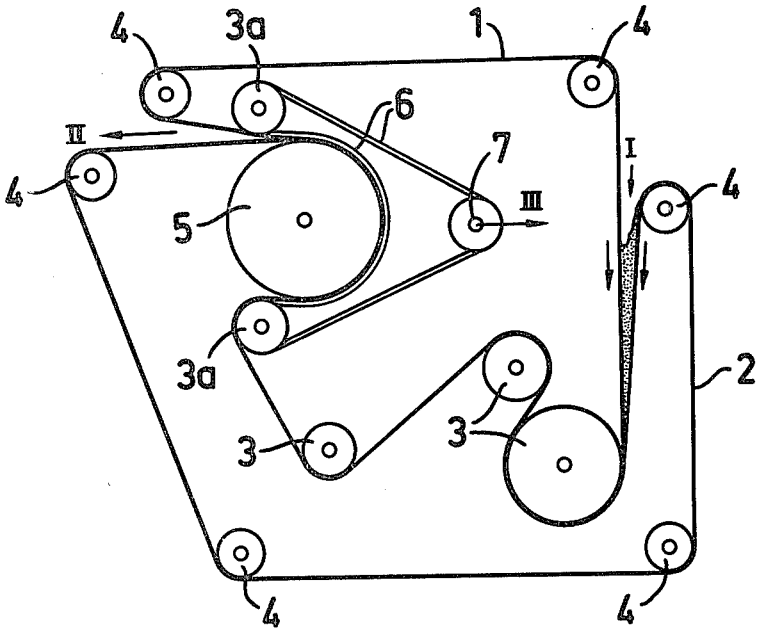
FIG. 2 shows in a schematic way a wire cloth press according to the invention in lateral view.
Figure 5:
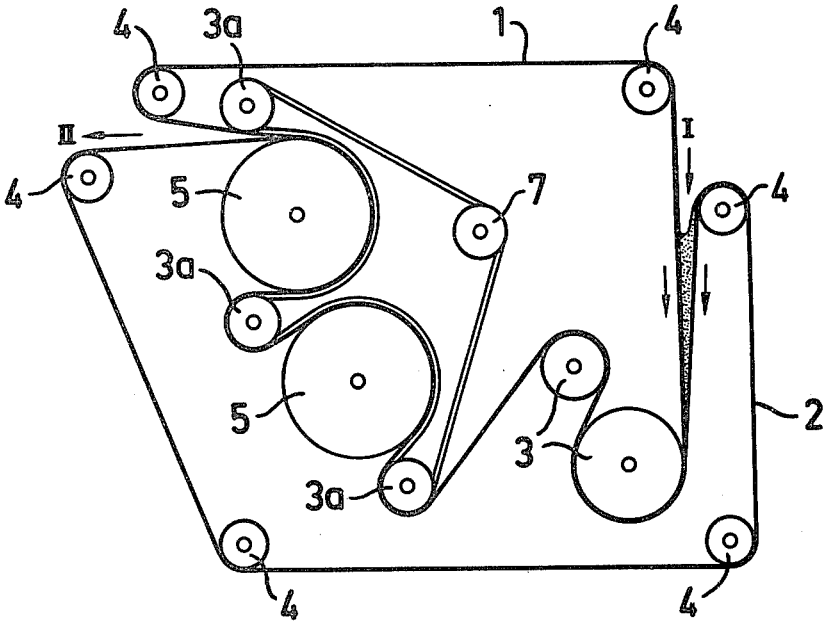
FIG. 5 shows in lateral view corresponding to FIG. 2 another embodiment of a wire cloth press according to the invention.

In both embodiments according to FIGS. 2 and 5 two endless wire cloth webs 1 and 2 run in common along a pressure path located between an inlet (illustrated by arrow I) for the suspension to be dewatered and an outlet (arrow (II) for the dewatered suspension and run each by itself over guide rolls 4. Along the pressure path a first dewatering takes place by the fact that the webs with the suspension therebetween in a manner known per se pass over a selected number of rolls 3 and partly enclose these rolls. The pressure here being applied on the suspension is dependent on the strength to which the webs are subjected and which as to its magnitude is limited. This web stretch can within certain limits be adjusted, for instance by moving at least one of the guide rolls 4.

Figure 3:
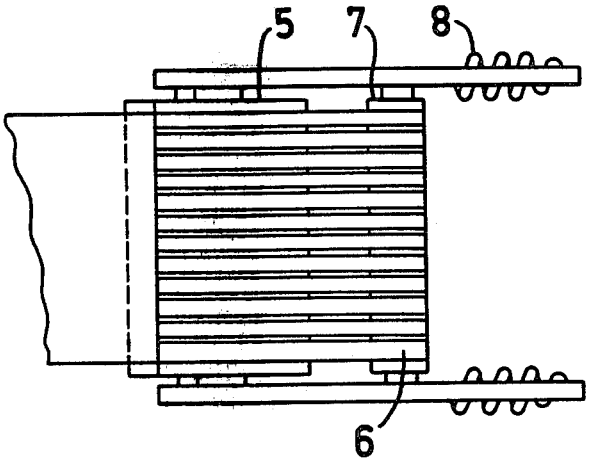
FIGS. 3 and 4 show in enlarged scale and in plane view a part of the wire cloth press and, respectively, a part section view for illustrating more in detail the particularly characterizing of the invention.

As particularly characterizing for the present invention an essentially increased pressure is applied on the suspension between the webs 1 and 2 in the pressure path at a press roll 5 by means of a number of parallel band-shaped elements 6, preferably elastic belts. The belts run over the same rolls 3*a* as are guiding the webs in front of and behind the press roll 5 and also run over a stretch roll 7. In this way the belts abut under pressure the outer web relative to the press roll 5 along mainly the same length as the webs enclose the press roll. The stretch roll 7 and also the rolls 3*a* may preferably be grooved in order to maintain the parallelism between the belts. By moving the stretch roll 7, as shown with arrow III, for instance by means of spring or other mechanical devices, the pressure of the belts against the outer web can be adjusted. FIG. 3 shows in plane view and enlarged scale the press roll 5 and the stretch roll 7 and shows also in a schematic manner springs 8 as a device for bringing about the required pressur of the belts 6 against the outer web.

Figure 4:
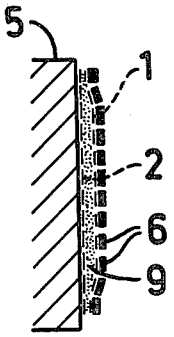

FIG. 4 shows a part section of the press roll 5 and shows on the surface of the roll the inner web 2, the suspension layer 9, the outer web 1 and the belts 6.

FIG. 5, finally, shows an embodiment having two press rolls 5. This embodiment is preferably used in case when the press time needs to be elongated without renounce of the capacity of the wire cloth press.

As evident from FIGS. 3 and 4 the belts 6 are arranged with a distance between each other. This distance should be choosen sufficient large, so that the water pressed out of the suspension will have time to flow out during the effective press-time. The distance shall, however, also be sufficient small in order to keep the outer web between the belts stretched such that a substantial pressure also exists between the belts. The distance between the belts should preferably be less than 20% of the belt width. The belts may consist of many different materials, such as rubber, plastic, and the belts may also be reinforced or in some other manner strengthened. It is advantageous that the belts have a certain elasticity. As indicated in FIG. 4, the suspension layer can have varying thickness along the web width. Generally, the suspension layer is probably thinned out towards the web edges. With an adjusted elasticity of the belts such a thinner suspension layer will be subjected to a sufficient pressure for dewatering. It is, however, according to the invention also possible to provide the outer belts with increased stress by means of extra stress rolls or other devices and thereby also hinder the suspension from flowing out towards the web edges.

The friction between the belts and the outer web is in most cases sufficient for the driving of the belts. If desired, however, a special drive may be arranged in an appropriate way for the driving and in such a case the driving should be synchronized with the drive (not shown) for the webs.

It is in certain cases advantageous to provide the belts with transverse grooves in order to facilitate the water outflow. In another embodiment the belts can be provided with transverse elevations which cause a relative movement in the suspension upon the pressure application. Said grooves and/or elevations can also be formed on the surface of the press roll 5. Grooves in the press roll in the form of axial riffles facilitate the water outflow through the inner web abutting the press roll. If comparatively wide webs are used, such webs may furthermore be provided with holes or slots.

In order to obtain as effective dewatering as possible and also in a constructional point of view it is advisable to have the belts pressing against the outer web along mainly the same length as the webs enclose the press roll, i.e., as shown in FIGS. 2 and 5 have the belts running over the same rolls which guide the webs ahead of and behind the press roll. It is, however, also possible to have the belts pressing against only a part of said web enclosing length, in which case separate guide rolls for the belts are arranged.

The pressure exerted on the suspension only by means of web tension without the use of an apparatus according to the invention, is in the order of magnitude of 1–2 kp/cm$^2$. By means of an apparatus according to the invention, however, considerably higher pressure can be obtained. For many kinds of slurries a pressure of 5–10 kp/cm$^2$ ought to be sufficient. Considerably higher pressure, 30–35 kp/cm$^2$, is, however, when necessary possible to apply.

Compared with wire cloth presses according to prior art it has been proved that when using a wire cloth press including the belt press according to the invention very high dry contents have been reached. For many kinds of slurries from wastewater treatment works dry contents of substantially over 30% have been possible to obtain when using a slurry press constructed in accordance with the invention. For certain kinds of slurries it has been possible to reach dry contents between 40–55%. The cause for this is, as mentioned above, a combination of high squeezing pressure and long press-time and also the possibility for the pressed out water to flow away. It could be of interest to compare these dry content values obtained when using an apparatus according to the invention with the dry contents obtained for similar slurries when using slurry presses according to the prior art described in the introductory part of the description. Thus, a dry content of about 20% is obtained upon dewatering between two webs running over a number of rolls and about 25% if in addition a pressing against the webs by means of pressure rollers is carried out.

A collecting vessel (not shown) for the pressed out water can be arranged in some manner known per se. To be able to reach the high dry contents, which become more and more desirable, among other things in a transportation point of view, it is advantageous to remove the pressed out water before the pressure relieves. This can be carried out by blowing or sucking away the water by means of a strong air stream guided over the web between the belts.

As is evident from the embodiments shown in FIGS. 2 and 5, a predewatering of the suspension takes place after the inlet I at the rolls 3 before the final dewatering takes place at the press roll or rolls 5. Such a predewatering can, however, be carried out before the inlet I and such a predewatering can furthermore be carried out by means of other devices than rolls corresponding to the rolls 3. With such a predewatering before the inlet I the rolls 3 in the pressure path between the inlet I and the outlet II can be omitted. p The invention, of course, is not restricted to the embodiments described above and shown in the drawings, but can be varied in several ways within the scope of the following claims in order to achieve the pursued dewatering effect by exerting the suspension between the webs enclosing the press roll to the additional pressing along spaced apart pathes extending along preferably the whole enclosing part. Thus, the belts can be connected with each other by means of elastic softer connections, for instance in order to facilitate the guidance of the belts along their pathes.

What we claim is:

1. Apparatus for removing liquid from a suspension comprising:

a pair of continuous webs movable over a portion of their length along a common path having an upstream end and a downstream end, at least one of the webs being pervious to liquid;

inlet means adjacent to the upstream end of the common path for introducing a suspension between the webs;

outlet means at the downstream end of the common path for removing a relatively dried suspension from the webs;

first pressure means for applying a first pressure to the suspension carried between the webs to remove a portion of the liquid therefrom, the first pressure means comprising a first press roll having a substantially continuous circumferential surface about which the pair of webs pass for a substantial portion of its circumference;

second pressure means located downstream along the common path of the webs from the first pressure means, the second pressure means comprising a second press roll having a substantially continuous circumferential surface about which the pair of webs pass for a substantial portion of its circumference; and pressure belt means cooperating with only the second of the first and second pressure means and extending around a substantial portion of the circumference of the second press roll to apply a substantially constant second pressure which is greater than the first pressure to the suspension carried between the webs as they pass around the second press roll, thereby enhancing removal of further liquid from the suspension.

2. Apparatus according to claim 1 wherein the pressure belt means comprises a plurality of spaced-apart belt-like elements.

3. Apparatus according to claim 2 wherein the outer web with respect to the second press roll is pervious to liquid, permitting removal of a substantial portion of the liquid through the open spaces between the belt-like elements.

4. Apparatus according to claim 1 including means for adjusting the pressure applied by the pressure belt means to the pair of webs.

5. Apparatus according to claim 1 wherein the pressure belt means comprises an elastic material.

6. Apparatus according to claim 1 wherein the pair of webs pass around at least 180° of the circumference of the first press roll.

7. Apparatus according to claim 1 wherein the pair of webs pass around at least 180° of the circumference of the second press roll.

8. Apparatus according to claim 1 including at least two guide rolls for guiding the pair of webs and the pressure belt means around the second press roll.

9. Apparatus according to claim 1 in which the pressure belt means is arranged to apply the second pressure across the entire width of the pair of webs containing the suspension.

* * * * *

UNITED STATES PATENT AND TRADEMARK OFFICE

Certificate

Patent No. 4,172,416 Patented October 30, 1979

Sven Anders Samuel Hakansson

Application having been made by Sven Anders Samuel Hakansson, the inventor named in the patent above identified, and Rederiaktiebolaget Nordstiernan, A Swedish Joint Stock Co., the assignee, for the issuance of a certificate under the provisions of Title 35, Section 256, of the United States Code, adding the name of Bengt Lundh as a joint inventor, and a showing and proof of facts satisfying the requirements of the said section having been submitted, it is this 1st day of Mar. 1983, certified that the name of said Bengt Lundh is hereby added to the said patent as a joint inventor with the said Sven Anders Samuel Hakansson.

Fred W. Sherling,
*Associate Solicitor.*

UNITED STATES PATENT AND TRADEMARK OFFICE

CERTIFICATE OF CORRECTION

PATENT NO. : 4,172,416

DATED : October 30, 1979

INVENTOR(S) : Sven Anders Samuel Hakansson

It is certified that error appears in the above-identified patent and that said Letters Patent is hereby corrected as shown below:

Column 4, line 48, change "webs" to --belts-- in both instances.

Signed and Sealed this

*Thirteenth* Day of *November 1984*

[SEAL]

*Attest:*

GERALD J. MOSSINGHOFF

*Attesting Officer*

*Commissioner of Patents and Trademarks*